United States Patent [19]

Kawanami et al.

[11] 4,061,005

[45] Dec. 6, 1977

[54] METHOD AND APPARATUS FOR CONTINUOUS BENDING OF ELONGATED MATERIALS

[75] Inventors: Shunpei Kawanami, Hiratsuka; Yukimitsu Hanamoto, Yokohama, both of Japan

[73] Assignee: Daiichi Koshuha Kogyo Kabushiki Kaisha, Japan

[21] Appl. No.: 639,195

[22] Filed: Dec. 9, 1975

[30] Foreign Application Priority Data

Sept. 18, 1975 Japan ..... 50-113468

[51] Int. Cl.[2] ..... B21D 7/12; B21D 7/16; B21D 9/00

[52] U.S. Cl. ..... 72/30; 72/128; 72/166; 72/307; 72/369

[58] Field of Search ..... 72/128, 342, 364, 369, 72/370, 11, 12, 17, 31, 166, 306, 307

[56] References Cited

U.S. PATENT DOCUMENTS

| | | | |
|---|---|---|---|
| 2,286,893 | 6/1942 | Boissou | 72/369 X |
| 2,996,100 | 8/1961 | Newhall et al. | 72/364 X |
| 3,229,489 | 1/1966 | Huet | 72/128 X |

*Primary Examiner*—Francis S. Husar
*Assistant Examiner*—Gus T. Hampilos
*Attorney, Agent, or Firm*—Burns, Doane, Swecker & Mathis

[57] ABSTRACT

A method of continuously bending elongated materials may comprise engaging one portion of the elongated material with a guiding means and clamping a second portion of the elongated material in a clamping device driven to rotate with a movable axis of rotation perpendicular to a horizontal plane. A heated zone bounded by a cooled zone moving relative to the elongated material may be established in the material by suitable heating and cooling means disposed adjacent to the material. The elongated member may be driven to pass through the guiding means. Where a hollow elongated material is to be bent, a compressing means may be placed within the elongated material to inhibit deformation of the cross-section of the material. An apparatus for continuously bending elongated members may be comprised of plural means for performing the aforestated functions.

20 Claims, 6 Drawing Figures

FIG. 1
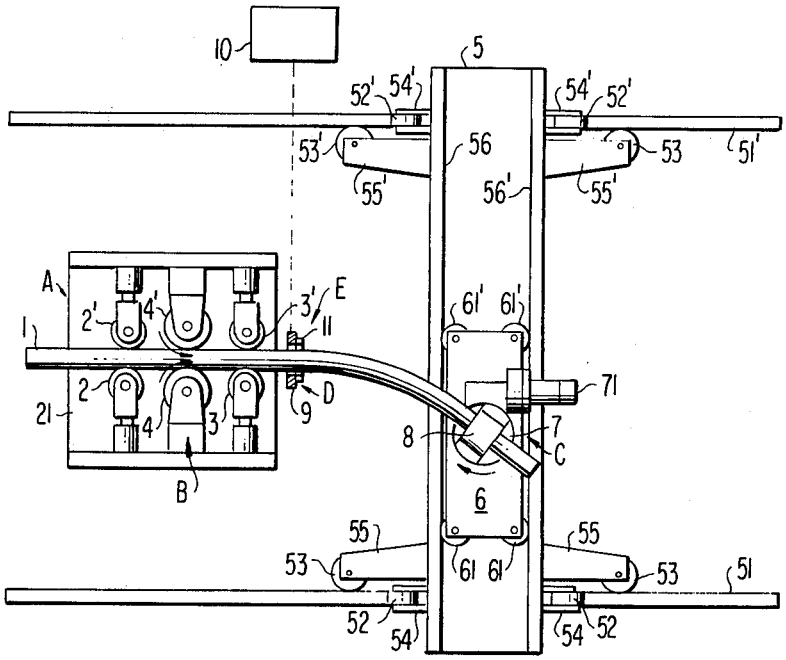
FIG. 2
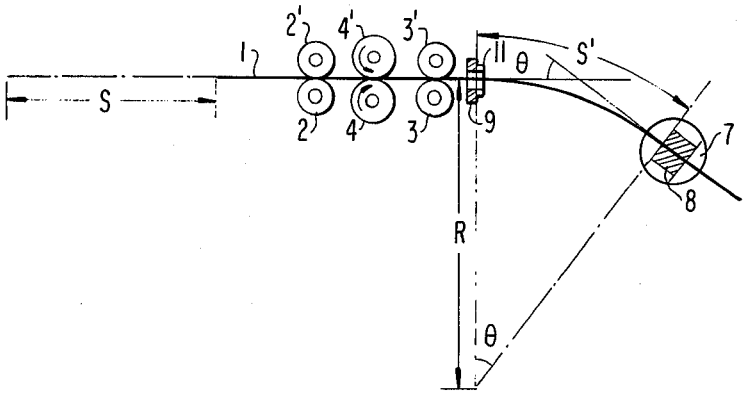
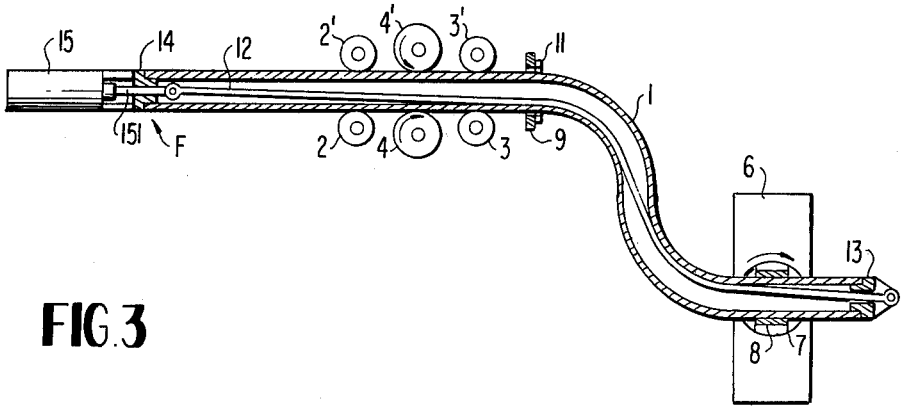
FIG. 3

METHOD AND APPARATUS FOR CONTINUOUS BENDING OF ELONGATED MATERIALS

BACKGROUND OF THE INVENTION

Hitherto three types of cold benders have been employed to bend elongated material. The first type is equipped with a forming roll, a mandrel and other dies and bends a pipe by winding it around the forming roll. The second type is equipped with forming dies and can bend a pipe through pressing the dies. The third type is equipped with three rolls and can bend a pipe by feeding the pipe through these rolls which exert pressure while rolling due to an offset arrangement of the rolls.

The first type of bender requires many different forming rolls to provide various curvatures and many mandrels and other dies for different sizes of finished product. This first type of bender is not suitable for large relative radius bending. For the purposes of this disclosure the term "relative radius" means bending radius divided by the diameter of pipe to be bent, R/D. The second and the third types of benders are suitable for large relative radius bending but it is difficult to achieve accurate bending with these devices. The second and third types are not suitable for small relative radius bending.

A device disclosed in Japanese Pat. No. 419,799 may correct some of these defects. That device consists principally of means performing the following functions: supporting and guiding an elongated material to be bent with two pairs of guide rollers at the intermediate part of it, clamping said elongated material at its top end with a clamp connected on a bending arm which can rotate freely around the center of bending, driving said elongated material along its axis at a constant speed, heating said elongated material at the vicinity of said guide roll in a limited narrow circular zone with high frequency induction heating. In this way the elongated material may be bent without the use of forming rolls. The device of Japanese Pat. No. 419,799 solves many problems inherent in the aforementioned three types of benders. However, it is not suitable for very large bending radii for example 50 meters, because the bending radius is limited by the length of bending arm. The device also requires reclamping of the elongated material at a different place to proceed with step of bending, and requires a shifting of the center of bending and a change in the effective length of bending arm in order to change the radius of the bend formed by the device. Likewise, the first type of bender is not able to perform plural bending continuously or not continuously in one process without reclamping.

Accordingly, a primary object of the present invention is to provide an apparatus capable of performing a continuous or discontinuous plural bending of an elongated material including various or variable curvatures as well as normal single bending with a constant curvature.

Another object of the present invention is to provide a method and apparatus for performing not only a single bending of constant radius but a plural bending including various and/or variable bending radius and/or various bending angles in one process, continuously or discontinuously without any reclamping of said elongated material to be bent.

A further object of the present invention is to provide a means for bending continuously or discontinuously, piping components with several bends, for instance, plurally bent pipe used for chemical plants, refineries and many other uses; or expansion bends such as the double offset bend or zigzag bend, and turn piece often used for underground piping.

Yet, a further object of the present invention is to provide a bending apparatus and method which promotes productivity of plural or complex bends and reduces the cost of fabrication of piping making possible new types of compact bends, heretofore impractical to produce because of the need of reclamping the pipe in a convention bender to produce such bends.

These and other objects and features of the invention will become apparent from the claims and from the following description when read in conjunction with the appended drawings.

BRIEF DESCRIPTION OF THE DRAWINGS

FIG. 1 is a plan view of one embodiment of the present invention.

FIG. 2 is a diagram showing positioning of elements of the embodiment of FIG. 1.

FIG. 3 is a cross-sectional plan of one embodiment of the present invention showing a first embodiment of a compressing means.

DETAILED DESCRIPTION

Figure 4:
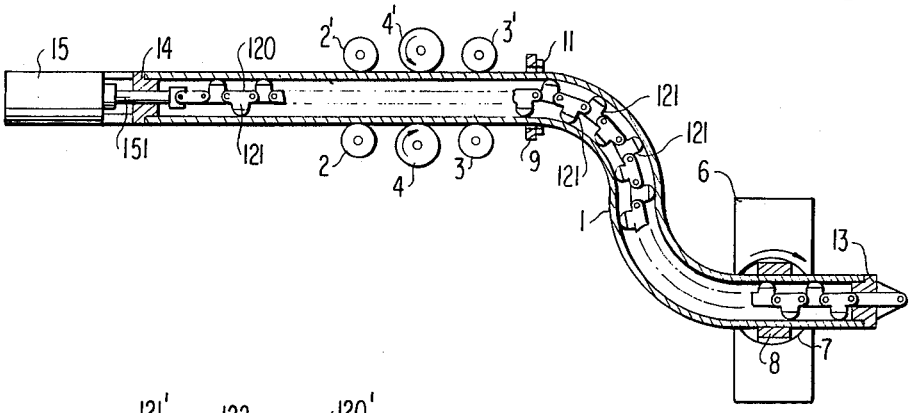
FIG. 4 is a cross-sectional elevation of one embodiment of the present invention showing a second embodiment of a compressing means.

In accordance with the present invention an apparatus and method for bending elongated material is provided which facilitates the forming of plural bends of various and/or variable curvatures, continuously or discontinuously, in one operation without reclamping the elongated material.

In accordance with the present invention, a method of bending elongated material is provided, characterized by the following steps: freely guiding elongated material to be bent along its principle axis with a guiding means consisting of, for example, sets of rollers or other means for establishing moving engagement with the elongated material at suitable intermediate locations along said elongated material; clamping said material at one end with a clamping means capable of imparting a moment to the material by means of adequate driving power and at the same time capable of moving freely in a horizontal plane; rotating said clamping means through a desired angle at a desired speed thereby imparting a simple, pure bending moment to said material; heating the elongated material by means of an induction heating coil or gas burner at a location between the guiding means and clamping means in a limited narrow zone perpendicular or nearly perpendicular to the axis of said elongated material in order to minimize resistance against plastic deformation while slowly moving said narrow heated zone relative to the elongated material along the principle axis of said material.

For the purposes of this disclosure "principal axis of the material" shall include a straight and/or curved line centered within the cross-section of the elongated material. "Principal axis of an unbent portion of the material" or "extended principal axis of an unbent portion of the material" includes a substantially straight line extending to infinity centered within the cross-section of the unbent portion of the elongated material.

In accordance with the present invention, an apparatus for bending elongated material is provided, comprising a guiding means for establishing a stationary point of engagement with the elongated material moving relative to said guide means; and movable bending means for engaging the elongated material imparting a moment to the material and at the same time capable of moving freely in a horizontal plane. The guiding means may include two or more pairs of guide rollers wherein the rollers of each pair are disposed on either side of the elongated material. The guiding means may be operative to guide the elongated material at an intermediate location along the principle axis of the material.

The bending means may include a clamp means for slidably engaging the elongated material. The clamp means may be driven to rotate by a torque imparting means attached thereto. A suitable driving motor coupled to the torque imparting means, may give the elongated member a bending moment. The torque imparting means may be carried by a frame, movable along a first axis parallel to the principal axis of the unbent portion of the elongated material, and by a sliding member constrained to move on said frame relative to said frame along an axis perpendicular to said first axis.

Feeding means may be provided with which to drive the elongated material through said guide means. An induction coil for gas heater or other heating means may be employed to heat the elongated material in a narrow zone substantially perpendicular to the elongated material; the heating means may be installed between the guiding means and the bending means. A means for cooling the heated elongated material may be provided between the heating means and the bending means to cool the elongated material at a forward edge of a heated zone in which plastic deformation of the heated zone has been completed. The apparatus may be equipped with an additional compressing means to give the elongated material compressive stress in order to prevent reduction of wall thickness of the material when such reduction is undesirable.

Referring now to FIG. 1, an embodiment of the present invention is shown by which an elongated member 1, for example, a straight pipe, may be deformed into a bent elongated member.

A guiding means for establishing engagement with the elongated material moving relative to said guide member, is designated generally by the letter A. The guiding means may be comprised of two pairs of guide rollers 2 and 2', and 3 and 3'. The guide rollers may be installed on a fixed base frame and may support and guide the elongated material freely along the principle axis of the material. A set of symmetrically opposed pinch rollers 4 and 4' may engage the elongated material. The pinch rollers may be driven by a motor at a suitable speed to feed the elongated material. Pinch rollers 4 and 4' are designated generally by the letter B.

A movable bending means is designated generally by the letter C. The bending means may include a nearly rectangular frame 5 situated perpendicular to the principal axis of the unbent portion of the elongated material. The frame 5 may be movable only in a direction parallel to the principle axis of the unbent portion of the elongated material engaged by guiding means A. The frame may travel along guide rails 51, 51' on wheels 52, 52' which are free to roll along said guide rolls. The wheels are pivotably attached to support members 54, 54' which are attached to the frame 5. The frame 5 may also be equipped with second support members 55, 55', each carrying wheels 53 and 53', respectively. The wheels 53 and 53' may roll along the side surface of guide rails 51 and 51' and may be operative to prevent the frame 5 from rotating in reaction to torques or other forces generated in bending the elongated material.

Guide surfaces 56 and 56' are formed in the frame 5 to constrain the motion of slide base 6. Wheel 61 and 61', pivotably mounted on the slide base, permit the slide base to move freely relative to the frame 5 in a direction perpendicular to the principal axis of the unbent portion of the elongated material 1. A circular table 7, installed near the center of the slide base 6, may be rotated slowly by means of motor 71. The circular table may be equipped with a clamp 8 which may be employed to clamp the elongated material 1 and to generate bending moment or torque in the elongated material.

A circular electric induction heating coil or gas burner may be provided in proximity of guide rollers 3, 3'. A zone heated by the induction heating coil or gas burner may be substantially perpendicular to the principal axis of the unbent portion of the elongated member. The heating coil or gas burner may be operative to heat the elongated member in a limited narrow zone in which plastic deformation for bending should occur. The heating coil or gas burner may be equipped with a transformer or gas supply 10 to provide the necessary power for heating. A heating means is designated generally by the letter D.

A means for cooling the elongated material 1 is denoted generally by the letter E. The cooling means may include a ring jacket equipped with a plurality of openings to supply fluid, e.g., water, air, mist, etc., in order to cool the elongated material leaving the heated zone and, thereby, limit the width of the heated zone. The cooling means may be operative to prevent excess deformation of the elongated material. The cooling means may be connected to a source of cooling fluid (not shown).

The above described apparatus can satisfactorily carry out the method of the present invention. The theoretical basis for this embodiment may be explained with reference to the apparatus of FIG. 1 and the schematic diagram of FIG. 2.

The bending of an elongated material may be performed as follows: tightly clamping the elongated material 1, supported and guided by means of the two pairs of guide rollers 2 and 2', and 3 and 3' of guiding means A, then aligning said guide rollers, starting a motor 71 to drive circular table 7 and clamp 8, and at the same time starting a motor (not shown) to drive feeding means in order to feed pipe 1 in a proper speed in accordance with a predetermined program. At the same time heating means D and cooling means E may be activated. In this way, bending operation is started.

A program to drive above-mentioned motor (not shown) to operate the feeding mean B and to drive the motor 71 of torque imparting means C can be determined according to the following relation, where

| | |
|---|---|
| feeding speed of elongated material = | $ds/dt$ |
| displacing speed of bent portion of elongated material = | $ds'/dt$ |
| angle of bending which is substantially equal to the angle of rotation of clamp 8 | $\theta$ |

-continued

| | |
|---|---|
| first derivative of the angle of rotation with respect to time (angular velocity) | $d\theta/dt$ |

Assuming there is no compression, tension, nor shearing of the elongated material at the heated zone which is between unbent and bent portions of the elongated material, $ds/dt = ds'/dt$. Considering that there can exist only a pure bending moment at the heated zone, then the radius R of bending is determined in accordance with the following relation:

$$R = \frac{\text{bent length } (S')}{\text{bending angle } (\theta)} = \frac{ds'/dt}{d\theta/dt} \quad (1)$$

This formula shows that bending radius R is determined by the ratio of displacing speed of bent portion to angular velocity of rotation of clamp 8.

It follows from the above that a constant ratio of displacing speed of bent portion of the elongated material to the angular velocity of rotation of clamp 8 would give constant bending radius. Variation of one or both of the parameters, $ds'/dt$ and $d\theta/dt$ will yield various or varying bending radius. Of course, if elongated material 1 is simply fed into the apparatus without rotating the clamp 8 means, an infinitive ratio of the parameters is achieved; yielding an infinitive bending radius. The occurrence of an infinite bending radius indicates that displacement without bending has taken place. A program of the bending operation may be prepared in accordance with aforestated theoretical relationship and the requirements of the finished product. Plural bending including various and/or varying bending radius with any bending angle can be performed. In addition to the various bends achievable, the apparatus may be operative to produce straight portions in the elongated material, the so-called "neck" portions.

Generally, in the basic apparatus shown in FIG. 1, every guide and movable carriage is equipped with free rollers or wheels in order to minimize frictional resistance. In addition, the couples of rollers or wheels engaging the same side of the material or the same side of the track are displaced a sufficient distance from one another to minimize the reaction force on them caused by the movable bending means C. Hence no harmful frictional resistance will be experienced at the guide system for frame 5 and slide base 6, and hence there can exist substantially no excessive bending moment or shearing force other than simple pure bending moment required for bending of the material 1, caused by movable bending means C.

Due to the unique arrangement of the basic apparatus, of the present invention, a simple and pure bending moment is uniformly applied to a portion of elongated material 1 between guide rollers 3 and 3', and clamp 8. The material experiences substantially no other forces, hence the aforementioned formula (1) describes the bending radius accurately.

The above-described embodiment of the present invention is particularly suited to the forming of relatively large bending radius bends. However, difficulties may be encountered in producing relatively small bending radius bends in hollow elongated material such as pipe. The difficulties are due, in part, to undesirable variations in wall thickness. During bending, wall thickness may be reduced at the outside radius of bending and may be increased at the inside radius of bending. In order to prevent such wall thickness reduction, the embodiment of FIG. 1 may further comprise the below described means for preventing wall thickness reduction.

Wall thickness reduction may be prevented in two different ways. The first consists of controlling temperature distribution around the heated zone keeping larger radius side of the elongated material cooler than smaller radius side. This method may be carried out by installing the heating means 11 eccentric to the axis of pipe or elongated materials or cooling the larger radius side of the heated zone. The second consists of applying a compressive force along the axis of the pipe or elongated material and so increasing the wall thickness of the material while it is bent at the heated zone.

Figure 5:
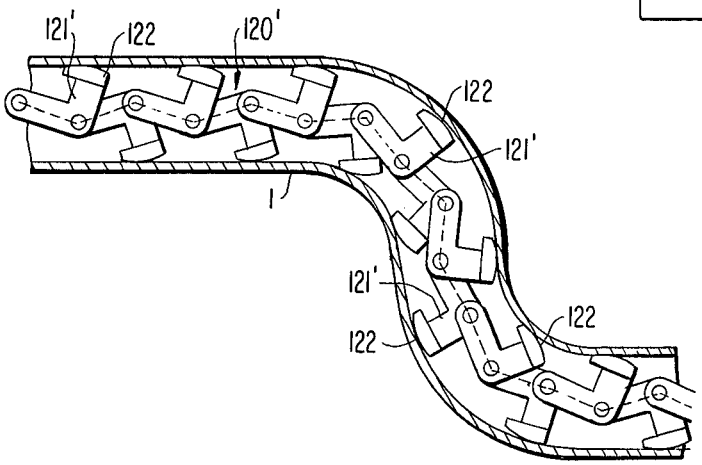
FIG. 5 is a cross-sectional elevation of a portion of an embodiment of the present invention showing a third embodiment of a compressing means.

The second method of preventing wall reduction may be accomplished as shown in FIGS. 3, 4 and 5 by installing a compressing means F in the hollow elongated material to be bent in the bending apparatus embodiment shown in FIG. 1.

Compressing means F may consist of a retainer such as wire rope 12 or other flexible, inextensible elongated means, inserted through the pipe or hollow elongated material 1, clasped at one end by means of clasp 13 provided at one end of pipe 1, and pulled at the other end by means of hydraulic cylinder 15 and piston rod 151 engaging the other end of pipe 1 through attachment 14.

Due to such arrangement of compressing means F, sufficient compressive stress is exerted throughout the whole length of pipe 1 before the pipe is placed in a bender, and can prevent the reduction of wall thickness caused by bending. Further, compressing means F may also be utilized in conjunction with other types of high frequency induction heating benders.

FIG. 4 shows an alternate embodiment of compressing means F consisting of chain 120, having protrusions 121, in place of wire rope 12.

Compressing means F shown in FIG. 3 is quite effective for large relative radius bending, but is not so effective for small relative radius bending, because the angle of inclination between the axis of wire rope 12 and the axis of pipe 1 becomes larger for smaller relative bending radius, hence the direction of the compressing force cannot be kept parallel to the axis of pipe 1. In small radius bending applications the wire rope may give some amount of harmful bending moment due to said inclined pull, resulting in inaccurate bending.

In contrast, compressing means F shown in FIG. 4 can exert only pure compression without any bending moment or shearing force because the axis of pipe 1 and the axis of chain 120 are constrained to substantially coincide with each other by means of a later described expedient. The chain 120' shown in FIG. 5 provides another form of the compressing means which may be operative as a mandrel because of special shape of each link to prevent flattening of the bent portion of the elongated material. Chain 120 consists of T-shaped links with protrusions 121 extending in alternate direction which may ensure that the axis of chain 120 coincides with the axis of pipe 1 throughout its whole length without regard to bends in the chain or pipe. On the other hand, chain 120' may consist of L-shaped links, wherein a suitably curved surface 122 is formed on the end of each protrusion 121' extending perpendicularly from the axis of each link at the coupling pin of each link. The shape and size of said protrusion is so selected as to make each curved surface 122 contact and push the inside wall of the pipe to some extent and to orient the protrusions of neighbouring links at an obtuse angle near 180° with respect to its neighbors. The alternate orientation of consecutive links may cause the axis of the chain to describe a zigzag pattern when it is inserted into the pipe 1 and pulled. Thus, the chain 120' may exert not only compressive force along the axis of pipe 1 as does the former embodiment but may also exert a force perpendicular to the principle axis of pipe 1 which is effective to a certain extent to prevent flattening of the pipe being bent. Hence, chain 20 may act as a flexible mandrel as well as a compressing means.

Figure 6:
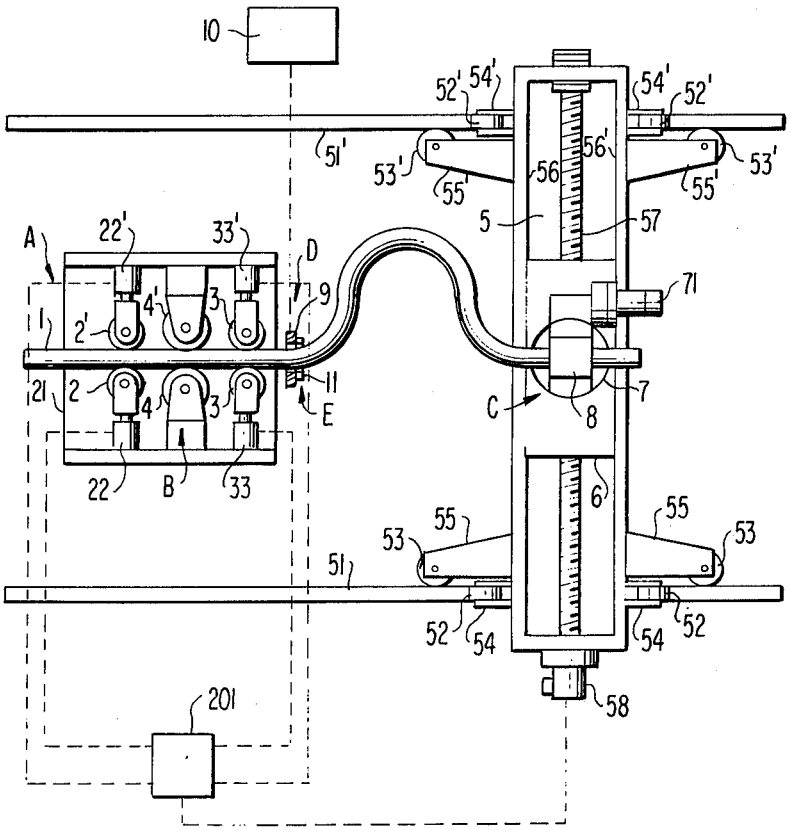
FIG. 6 is a plan view of an alternate embodiment of the present invention.

A further embodiment of the present invention is shown in FIG. 6. The embodiment of FIG. 6 may be operative to give more smooth motion of slide base 6 and consequently to yield greater bending accuracy. Referring to FIG. 6, frame 5 of the bending means C is equipped with a screw shaft 57 parallel to the axis of movement of the slide base 6, which shaft is driven with a servomotor 58. The slide base 6 may be equipped with a threaded member coupled with said screw shaft 57. Consequently, slide base 6 may be driven slowly in accordance with the rotation of screw shaft 57. The speed of said servomotor 58 is determined and controlled to equalize the reaction force on the diagonally opposed guide roll pairs 2-3' or 2'-3. Detectors 22, 22', 33 and 33', for example, load cells or other load detecting means, may be installed at the bottom of the support of guide roll 2, 2', 3 and 3', respectively, to detect the reaction force. These four detectors may be divided into two sets corresponding to the above-mentioned diagonally opposed guide roll pairs. The first set of said detectors may be 22 and 33' and the second set may be 22' and 33. The detectors may be connected to transmitter 201, and the output of each said detector 22, 33', 22' and 33 may be applied to said transmitter 201. The difference of the reaction force at the selected diagonal sets of guide rollers is measured and calculated in transmitter 201, which may determine the speed of servomotor 58 and hence the speed of motion of slide base 6 in order to maintain said difference of reaction force substantially zero. The transmitter may perform this function with the aid of proportioners and other controllers within transmitter 201 which supply driving energy to said servomotor 58.

The direction of said servomotor may be controlled by switching the connection of two sets of detectors with transmitter 201 according to prepared program.

In FIG. 6, other elements not herein mentioned, perform the same function as their counterparts in FIG. 1 denoted by the same numeral.

The embodiments of the present invention, as arranged and described above, provide a heated zone on the elongated material to be plastically deformed by means of bending moment caused by rotation of clamp 8. The apparatus provides simple, pure bending moment and without any shearing force, therefore, reaction force exerted on every part of this bender is reduced to minimum. Accuracy of bending is promoted for the following reason.

The bent portion of pipe 1 between the heated zone enclosed with heating coil 9 and clamped zone at clamp 8 bears no shearing force which is harmful to accuracy of bending, but bears a simple pure bending moment uniformly distributed throughout said bent portion of pipe 1. For this reason, bending may be carried out accurately. In addition, the elastic curve of the bent portion of pipe 1 remains circular and elastic deformation which causes spring-back of the bend to be easily and accurately calculated so that the bending radius and the bending angle can be very accurate.

The feeding means B, provided to move heated zone of elongated material along the axis of the material, need not be limited to the above-mentioned means which consist of pinch roller 4, 4' installed in guiding means A. A feeding means such as a screw, hydraulic cylinder, chain and other means for pushing the elongated material at its tail end may be substituted in place of said pinch rollers 4 and 4'. Another embodiment of a feeding means may be provided as follows. Fixing elongated material at its tail end of it, supporting said elongated material with guiding means A consists of two pairs of guide rollers not fixed on a fixed base but capable of moving together with the heating means along the axis of said elongated material not yet bent. In principle, to carry out this invention, any other feeding means is operative as long as it can function to move the heated zone of said elongated material to be bent along said elongated material in a proper relative speed.

The above-described embodiments of the present invention function to heat elongated material in a narrow limited zone which is to be deformed plastically with pure bending moment, move the heated zone in a proper relative speed along the axis of said elongated material to be bent, and give the elongated material a simple and pure bending moment by means of rotation of clamping device for instance, clamp 8 which clamps said elongated material at one end. The direction of rotation of the clamp 8 may be selectable by driving the clamp with the torque generating means which supports the clamp. It is, therefore, possible to control the ratio of moving speed of said heated zone to the angular velocity of said clamp 8 in order to determine a bending radius, and bending angle as well, in accordance with a prepared program.

The principles, preferred embodiments and modes of operation of the present invention have been described in the foregoing specification. The invention which is intended to be protected is not, however, to be construed as limited to the particular forms disclosed, since these are to be regarded as illustrative rather than restrictive. Variations and changes may be made by those skilled in the art without departing from the spirit and scope of the present invention.

We claim:

1. A method for bending elongated materials comprising the steps of:

guiding the elongated material to permit movement of the elongated material in a direction generally parallel to the principal axis of an unbent portion of the material;

clamping a portion of the material;

applying a bending force to the material by rotating a clamped portion of said material on an axis of rotation intersecting the clamped portion of the material, said axis being maintained substantially perpendicular to a plane and being freely displaceable;

heating a portion of the material intermediate the guided portion and the clamped portion of the material;

monitoring the reaction force on the material due to the application of the bending force; and rotating the clamped portion of said material and selecting the perpendicular distance of the displaceable axis of rotation from the extended principal axis of the unbent portion of the material in response to the monitored reaction force and a predetermined bending program.

2. The method of claim 1 wherein the heating of the portion of the material comprises heating a portion of the material lying between the rotated portion and the unbent portion of the material to minimize the resistance of the material to plastic deformation.

3. The method of claim 2 further comprising the step of cooling a portion of the material lying between the heated portion and the rotated portion to rigidify the material.

4. The method of claim 3 further comprising the step of feeding unbent material toward the clamped portion of the material so that the guided portion, heated portion, and cooled portion of the material move relative to the material along the principal axis of the material.

5. The method of claim 4 further comprising the step of applying a compressive stress along an axis substantially parallel to the principal axis of the material to prevent reduction of the wall thickness of the material.

6. The method of claim 5 further comprising the step of applying a compressive stress along an axis substantially parallel to the principal axis of the material to inhibit deformation of the cross-section of the material.

7. The method of claim 6 further comprising the step of applying force to said material directed radially outwardly from the principal axis of the material to inhibit deformation of the cross-section of the material.

8. An apparatus for bending elongated materials comprising:

guiding means for engaging elongated material moving relative thereto;

bending means associated with said guiding means for clamping a portion of the elongated material and for applying a bending force to the elongated material by rotating the clamped portion of the material on an axis of rotation, said axis being displaceable while being maintained substantially perpendicular to a plane including:

a frame moveable along a plane substantially parallel to the principal axis of an unbent portion of the elongated material engaged by said guiding means;

a slide member supported by said frame and moveable relative to said frame along an axis substantially perpendicular to the principal axis of the unbent portion of the elongated material engaged by said guiding means; and, a clamping device for engaging the elongated material, supported by said slide member and driven to rotate with respect to said member; and, heating means for heating a portion of the material said heating means being located intermediate the guiding means and the clamping device.

9. The apparatus of claim 8 wherein said heating means is operative to heat a portion of the elongated material to minimize the resistance of the material to plastic deformation and wherein said heated portion is substantially perpendicular to the principal axis of the elongated material and moves relative to the material.

10. The apparatus of claim 9 wherein said heating means is disposed between said guiding means and said bending means.

11. The apparatus of claim 10 further comprising a means bounding the heated portion of the elongated material for cooling a portion of the elongated material to rigidify athe elongated material.

12. The apparatus of claim 8 wherein said slide member and said frame are freely moveable.

13. The apparatus of claim 8 further comprising means for driving said slide member to selectable locations along said frame.

14. The apparatus of claim 13 further comprising:

means for monitoring the reaction force on said guiding means due to application of the bending force to the material; and means controlling the rotation of the material and selecting the position of said slide member in response to the monitored reaction force and a predetermined bending program.

15. The apparatus of claim 8 wherein said guiding means includes two or more pairs of opposed rollers between which the elongated material is engaged.

16. The apparatus of claim 15 further comprising means for feeding the elongated material through said guiding means in a direction generally toward said moveable bending means.

17. The apparatus of claim 16 wherein said feeding means includes opposed pinch rollers between which the elongated material is engaged.

18. The apparatus of claim 8 further comprising means for applying a compressive stress along the principal axis of the material being bent to inhibit reduction of the wall thickness of the elongated material due to the bending of the material.

19. An apparatus for bending elongated materials comprising:

guiding means for engaging elongated material moving relative thereto, including:

first and second rollers disposed on opposite sides of an unbent portion of the material and displaced from one another along the longitudinal axis of the unbent portion of the material; and, means for applying force to the rollers so that the rollers exert oppositely directed forces of generally equal magnitude normal to the longitudinal axis of the material; and, bending means associated with said guiding means for clamping a portion of the material and for applying a bending force to the elongated material by rotating the clamped portion of the material on an axis of rotation, said axis being displaceable while being maintained substantially perpendicular to a plane, said bending means including:

a frame moveable along a plane substantially parallel to the principal axis of an unbent portion of the elongated material engaged by the guiding means;

a slide member supported by said frame and driven to move along an axis substantially perpendicular to the longitudinal axis of the unbent portion of the material responsive to the differential in force applied by the force applying means to maintain the forces exerted by the first and second rollers at a generally equal magnitude; and, a clamping device for engaging the material, rotatably mounted on the slide member.

20. The apparatus of claim 19 wherein said bending means engages the elongated material so that the principal axis of the elongated material and the axis of rotation are substantially perpendicular.

* * * * *